US006013013A

United States Patent [19]

Wolf

[11] Patent Number: 6,013,013

[45] Date of Patent: Jan. 11, 2000

[54] GOLF EXERCISER

[76] Inventor: Eugene M. Wolf, 55 Montacito Rd., San Rafael, Calif. 94901

[21] Appl. No.: 08/995,109

[22] Filed: Dec. 19, 1997

[51] Int. Cl.[7] ..... A63B 69/00; A63B 69/36

[52] U.S. Cl. ..... 482/111; 473/208; 482/114; 482/121; 434/252

[58] Field of Search ..... 473/207, 208, 473/211, 219; 482/110, 111, 112, 114, 122, 124, 126, 127, 136, 117; 434/252

[56] References Cited

U.S. PATENT DOCUMENTS

| | | | |
|---|---|---|---|
| 3,109,244 | 11/1963 | Trifaro | 473/409 X |
| 3,415,523 | 12/1968 | Boldt | 493/209 |
| 3,820,781 | 6/1974 | Kane | 473/409 X |
| 4,278,249 | 7/1981 | Forrest | 482/118 X |
| 4,326,718 | 4/1982 | Kiehl | 473/209 |
| 4,758,000 | 7/1988 | Cox | 473/208 |
| 4,809,971 | 3/1989 | Goldish | 482/904 X |
| 4,944,518 | 7/1990 | Flynn | 482/904 |
| 5,002,275 | 3/1991 | Beutler | 482/111 X |
| 5,050,871 | 9/1991 | Douglas | 482/136 X |
| 5,244,444 | 9/1993 | Wostry | 482/117 X |
| 5,244,445 | 9/1993 | Amesquita | 482/110 |
| 5,284,464 | 2/1994 | Lee | 482/136 X |
| 5,334,028 | 8/1994 | Melligan | 434/252 |

*Primary Examiner*—Richard J. Apley
*Assistant Examiner*—William LaMarca
*Attorney, Agent, or Firm*—Limbach & Limbach LLP

[57] ABSTRACT

The present invention provides a golf exercise apparatus that includes a resistance such that during an exercise emulating a golf swing, muscles of the axial skeleton and lower extremities of a golfer are strengthened. The golf exercise apparatus includes a support base, an axial shaft coulpled to the support base, and means for resisting the muscles of the golfer during the golf swing when the golfer is coupled with the shaft of the exercise apparatus. The golf exercise apparatus preferably provides progressive resistance to the muscles of the golfer during a downswing of the golfer. The support base preferably comprises at least one end having a reverse bevel such that the support base is securable under a closed door by wedging the end having the reverse bevel under the door. Alternatively, a support frame is coupled to the support base by wedging the end having the reverse bevel with the frame. The support base also preferably comprises at least one foot anchor for affixing at least one foot, and preferably two feet of the golfer to the support base. The apparatus is configurable to emulate a stance of the golfer when the golfer has an uneven lie. The present invention further provides a method of strengthening muscles of an axial skeleton of a golfer using means of resisting the muscles during an exercise emulating a golf swing of the golfer including the steps of coupling the golfer to the resistance means and performing successive exercises emulating golf swings against resistance provided by the resistance means to strengthen the muscles of the axial skeleton of the golfer.

32 Claims, 4 Drawing Sheets

RESISTIVE
MECHANISM - NO RESISTANCE ON BACKSWING
- PROGRESSIVE INCREASING RESISTANCE ON SWING
- HYDRAULIC OR OTHER RESISTIVE MECHANISM IN SHAFT

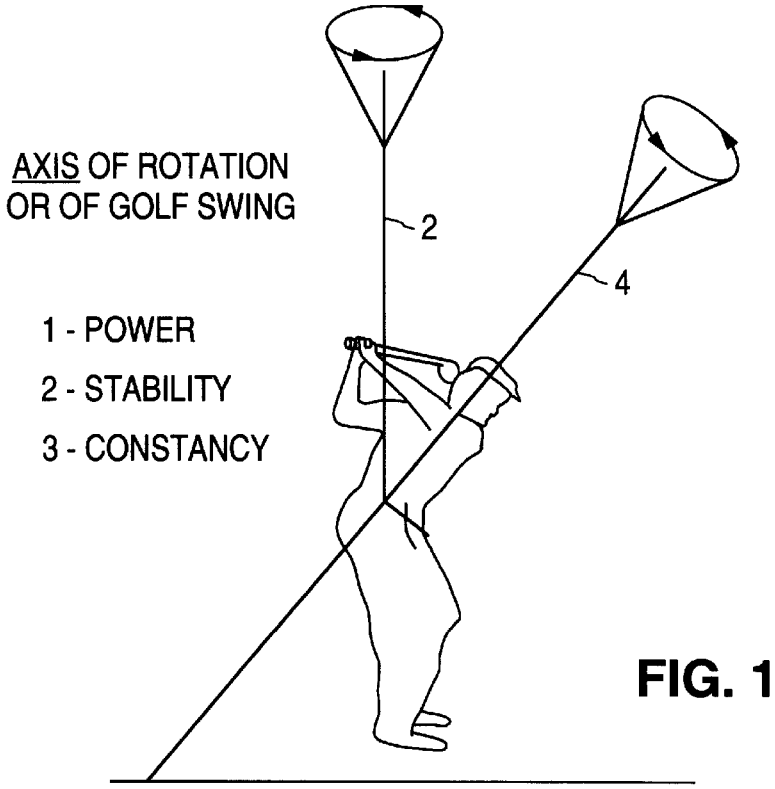
FIG. 1
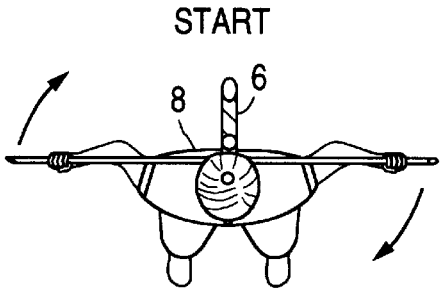
FIG. 4A
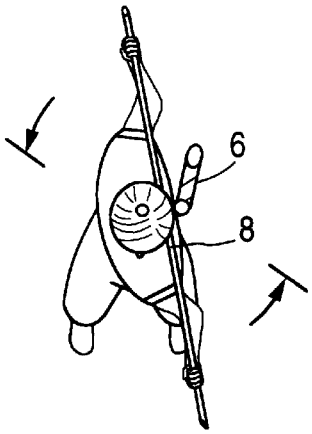
AGAINST
RESISTANCE
• VARIABLE
• (L) OR (R) HANDED
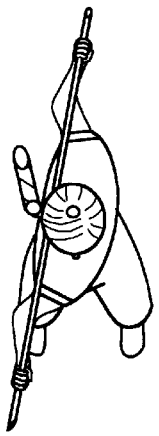
FIG. 4B
FIG. 4C RESISTIVE
MECHANISM - NO RESISTANCE ON BACKSWING
- PROGRESSIVE INCREASING RESISTANCE ON SWING
- HYDRAULIC OR OTHER RESISTIVE MECHANISM IN SHAFT RIGID BASE - FOOT PLATE / FORM VARIABLE
- VARIABLE LENGTH
- COMPRESSES FOR STORAGE, TELESCOPING

GOLF EXERCISER

FIELD OF THE INVENTION

The present invention relates to a golf exercise apparatus, and particularly to golf exercise apparatus which provides resistance to a golfer during a golf swing to strengthen the muscles of the axial skeleton of the golfer.

BACKGROUND OF THE INVENTION

Currently, golf is an activity enjoyed by many people of all ages possessing varying degrees of athletic ability and musculoskeletal strength and endurance. Although it is possible to perform a golf swing without having excessive musculoskeletal support, greater bodily strength and endurance allows a golfer to hit a golf ball farther and with greater accuracy and consistency for the entirety of a complete round of golf.

Golf enthusiasts purchase a large amount of golf paraphernalia to improve their golf swing. However, these paraphernalia generally only provide stability to specific areas of the body of the golfer that are active in the golf swing.

Existing golf paraphernalia include devices to improve the grip of the golfer by preventing the wrist of the golfer from moving to a position other than what is pre-set by the device. Special gloves also exist to direct the golfer to place his or her hands on the shaft of the golf club correctly.

External devices are currently being marketed to help train the muscles of the golfer to move along a predetermined path which is thought to be along an optimal golf swing path. These devices restrict the swing path of the golfer to a plane within which it is thought necessary to maintain the golf club throughout the golf swing. However, no resistance is supplied in the direction of rotation of the shoulders and upper torso, or the hips, of the golfer during performance of an exercise using an external device of this type. Further, these devices fail to train the golfer to progressively accelerate the golf club during the downswing.

Extendable golf club-like devices are currently being used which extend in response to centrifugal acceleration. During a practice golf swing of a golfer, the extendable device remains coiled during the first part of the golf swing if the golf swing is performed correctly, thus teaching a golfer to begin the downswing slowly. The device then becomes fully extended at the point of most rapid acceleration of the golf club, which should occur when the club face is in close proximity to a golf ball whose propulsion into the air is targeted as the object of the golf swing. The golfer is thus trained to accelerate the golf club at the proper time and along the correct swing path by the extension response of the device. Here, no resistance is provided and the golfer is not restrained to move along an optimal swing path.

In summary, existing golf devices either attach to the hands, wrists or other parts of the body of a golfer, or are held by the golfer, only to either train parts of the body of the golfer to maintain a correct orientation, restrain the golf swing of the golfer to a correct swing path, or train the golfer to accelerate at the proper point of the downswing. None of these devices actually provides resistance to optimally strengthen the muscles of the axial skeleton and lower extremities of the golfer which participate in the golf swing, while providing training to the golfer to accelerate properly and to maintain a proper orientation during the golf swing.

SUMMARY OF THE INVENTION

The present invention solves the aforementioned problems by providing a golf exercise apparatus that includes a resistance such that during an exercise emulating a golf swing, muscles of the axial skeleton and lower extremities of a golfer are strengthened, and proper swing dynamics are instilled. A golf exercise apparatus according to the present invention includes a support base, an axial shaft coupled to the support base, and means for resisting the muscles of the golfer during the golf swing when the golfer is coupled with the shaft of the exercise apparatus.

Other objects and features of the present invention will become apparent by a review of the specification, claims and appended figures.

BRIEF DESCRIPTION OF THE DRAWINGS

FIG. 1 is a side view of a golfer at the top of a backswing and preparing to execute a downswing, which illustrates the angular orientation of the respective axes of the shoulders and hips of the golfer.

FIG. 4A illustrates a starting position of a golfer performing golf exercises utilizing an embodiment of a golf exercise apparatus of the present invention.

FIG. 4B illustrates an intermediate position of a golfer performing golf exercises utilizing the apparatus of FIG. 4A.

FIG. 4C illustrates a finishing position of a golfer performing golf exercises utilizing the apparatus of FIG. 4A.

DETAILED DESCRIPTION OF THE PREFERRED EMBODIMENTS

Referring to FIG. 1, a correct golf swing has many, often illusory, components. One important component of a correct golf swing is its rotational, rather than translational, dynamic nature. The feet of the golfer with a mechanically sound golf swing are planted firmly on the ground until after the golf ball is struck. The knees are not rigid and are slightly bent. The hips of the golfer are vertical such that the golfer is on balance and not leaning in any direction. In this manner, the distribution of the weight of the golfer is substantially equal between the two feet of the golfer, and also between the heels and balls of the feet, at address. This even and balanced weight distribution about the feet varies only slightly throughout the backswing and the downswing leading up to the striking of the ball. Only after striking the golf ball does the weight shift substantially to the front foot of the golfer while the back foot leaves the ground to complete the follow through. During the entirety of a correct golf swing, the hips of the golfer simply rotate about a substantially vertical first rotational axis 2, while the shoulders and upper torso of the golfer rotate about a second rotational axis 4, offset in a forward direction from the first rotational axis 2.

FIG. 1 illustrates the angular relationship between the first rotational axis 2 and the second rotational axis 4 of the hips and shoulders, respectively, of a golfer during a golf swing.

The hips of a golfer rotate around the first rotational axis 2, and the shoulders and upper torso of the golfer rotate about the second rotational axis 4. The first rotational axis 2, that of the hips of the golfer, is substantially vertical, or more accurately, substantially perpendicular to the ground surface upon which the golfer is standing. The second rotational axis 4, that of the shoulders and upper torso of the golfer, is forward of the substantially vertical first rotational axis 2 of the hips. The first rotational axis 2 and the second rotational axis 4 are angularly offset from one another by an acute angle. The optimum specified angle varies from one golfer to another, and from one style of golf swing to another.

Intuition tells an ordinary golfer that he or she must produce translational momentum geared to striking the golf ball with a great impact. A first step to improving a golf swing is often to modify this intuitive thinking and get the golfer thinking and feeling rotationally. Once the golfer mentally and intuitively jumps the rotational hurdle, he or she often finds that the rotational nature of the golf swing is physically awkward. Moreover, the musculoskeletal constitution of the golfer is not normally prepared to do rotational battle with 18 holes of a golf course. This type of motion simply has not been practiced, and the strength and endurance of the muscles and joints involved in the golf swing are lacking.

Structure

Figure 2:
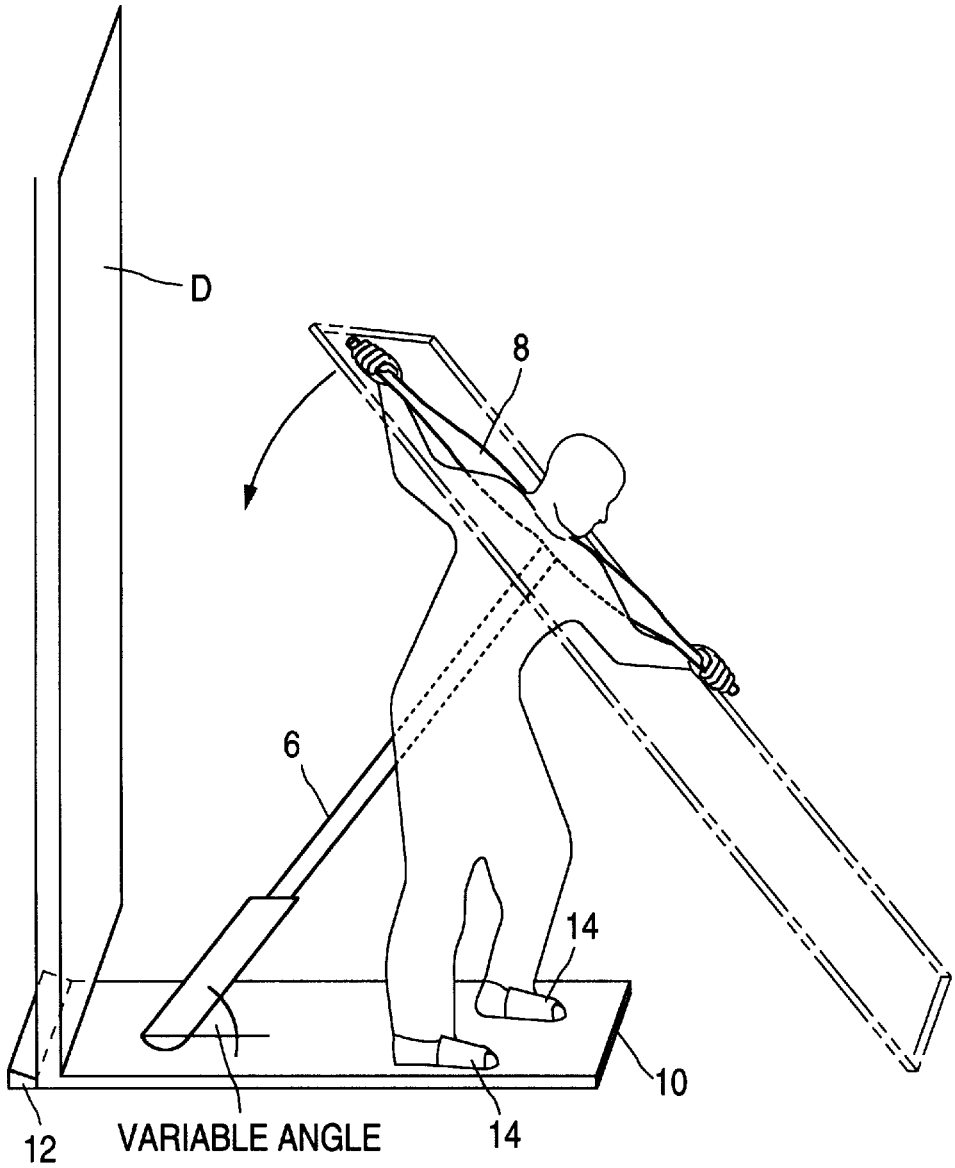
FIG. 2 is a perspective view of a golf exercise apparatus according to the present invention and illustrates an intermediate position of a golfer performing golf exercises using the apparatus.

The apparatus of the present invention is directed towards improving the strength and endurance of the muscles of the axial skeleton and lower extremities while instilling proper swing dynamics. Referring to FIG. 2, a golf exercise apparatus according to the present invention includes a support base 10, an axial shaft 6 coupled to the support base, and a shaft attachment 8 which is rotatably coupled to the axial shaft. During use, the user stands on the support base 10 with the shaft attachment 8 across his/her shoulders, with his/her hands gripping the shaft attachment, and with the axial shaft 6 thus supported by his/her shoulders and arms. While positioned in this manner, the user simulates the body movements of a golf stroke. The attachment assembly 8 facilitates rotation about the first rotational axis 2 and the second rotational axis 4 of the hips and shoulders, respectively, of the exerciser/golfer. The attachment assembly 8 may be an elongate tubular or planar member or any shape or size which will permit the user to perform the exercise when s/he is coupled with the axial shaft 6 via the shaft attachment assembly 8 by supporting the attachment with the shoulders and/or arms and/or by gripping it with the hands.

The shaft 6 and shaft attachment 8 are rotatably coupled in a manner which provides resistance to the user as s/he rotates the shaft attachment 8 about the shaft 6 during the downswing motion of a simulated golf stroke. This resistance is preferably either built into the shaft 6 or provided about the shaft 6. The resistance mechanism may be a torsional spring, or a hydraulic or pneumatic resistance associated with the axial shaft. The resistance may be provided in other ways such as by an elastic band attached to the golfer or another element of the golf exercise apparatus other than the shaft 6. The resistance mechanism can include a gravitational force such as may be redirected by a pulley and provided by an apparatus having a variable mass. In a preferred embodiment though, the resistance means is torsionally coupled with the shaft 6. and a resistance is coupled with the axial shaft 6 near the bottom of the shaft 6 closest to the point of coupling of the shaft 6 with the support base 10. However, the resistance may be supplied anywhere within or along the shaft 6, or may be wholly separate from the shaft 6.

Figures 3A, 3B:
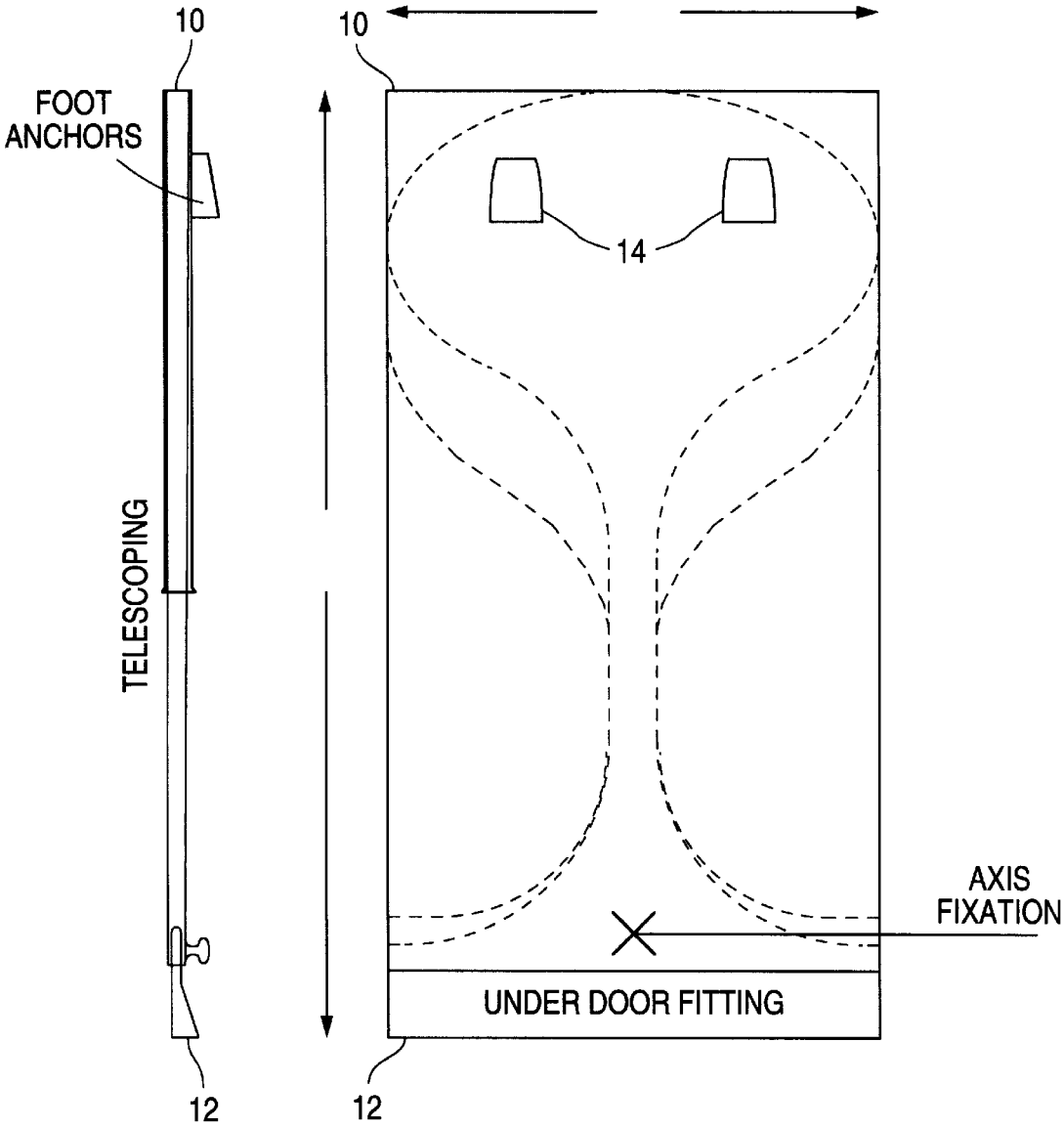
FIG. 3A is an overhead view of a support base of a golf exercise apparatus according to another embodiment of the present invention.
FIG. 3B is a side view of a support base of a the golf exercise apparatus of FIG. 3A.

Referring to FIGS. 3A and 3B, base support 10 is provided with the present invention to anchor the axial shaft 6. The coupling of the axial shaft 6 to the base support 10 can be by any of a variety of conventional means such as a U-joint, ball bearing or hinge-type mechanism. The axial shaft 6 couples with the support base 10 such that the axial shaft 6 and support base 10 form an acute angle. Preferably, the axial shaft 6 points from the base support 10 along a line substantially collinear with the second rotational axis 4 of the shoulders and upper torso of the exerciser/golfer.

The coupling mechanism of the axial shaft 6 with the support base 10 is preferably such as will allow the angle that the axial shaft 6 makes with the plane of the support base 10 to be adjustable. This is desirable because each exerciser/golfer has a unique second axis of rotation 4 of the shoulders and upper torso. Once adjusted to form a desirable angle with the support base 10, the axial shaft 6 should be fixed with respect to that angle to prevent an exerciser/golfer from displacing his or her second axis of rotation 4 of the shoulders and upper torso during the exercise emulating the golf swing. The axial shaft 6 may, however, be coupled with the support base 10 without having this angle fixed, and the golf exercise apparatus would still function to strengthen the muscles of the axial skeleton and lower extremities of the exerciser/golfer. Also preferably, the coupling mechanism of the axial shaft 6 with the support base 10 has minimal lateral play because one function of the present invention is the training of the exerciser/golfer to move neither his or her first rotational axis 2 nor second rotational axis 4 substantially when performing a golf swing.

In another embodiment, the angular and lateral play of the axial shaft 6 with respect to the support base 10 may be adjusted by the exerciser/golfer. In this way, he or she can first perform the exercise with an angularly and laterally fixed axial shaft 6, and then later without the shaft 6 being fixed in either the angular or lateral or both direction(s). The latter exercise more accurately emulates a true golf swing while the former trains and strengthens the muscles of the axial skeleton and lower extremities of the golfer to swing the golf club powerfully and efficiently along a correct swing path.

The support base 10 is wide enough to accommodate any size golfer to stand on top of the support base 10 while performing an exercise. Exemplary dimensions for the surface area of the support base 10 in a preferred embodiment of the present invention are thirty inches by sixty inches, or about 2.5'×5'. The support base 10 and axial shaft 6 may telescope to reduce its size for storage. Alternatively, the support base 10 as well as the axial shaft 6 may be collapsible by folding or fragmentation.

The apparatus may be further equipped with one or more mechanisms for securing the base against movement during exercise. For example, as shown in FIGS. 3A and 3B, the support base 10 may have a reverse bevelled end 12 running along the entire width or a portion of the width of the support base 10. In another embodiment, both ends of the support base 10 along the length of the support base 10 have a reverse bevel. Such reverse bevelled end 12 portions may be wedged under a closed door to secure the base into position from translational movement along the floor or to stabilize the base from rocking while an exerciser/golfer is performing an exercise.

Figure 3C:
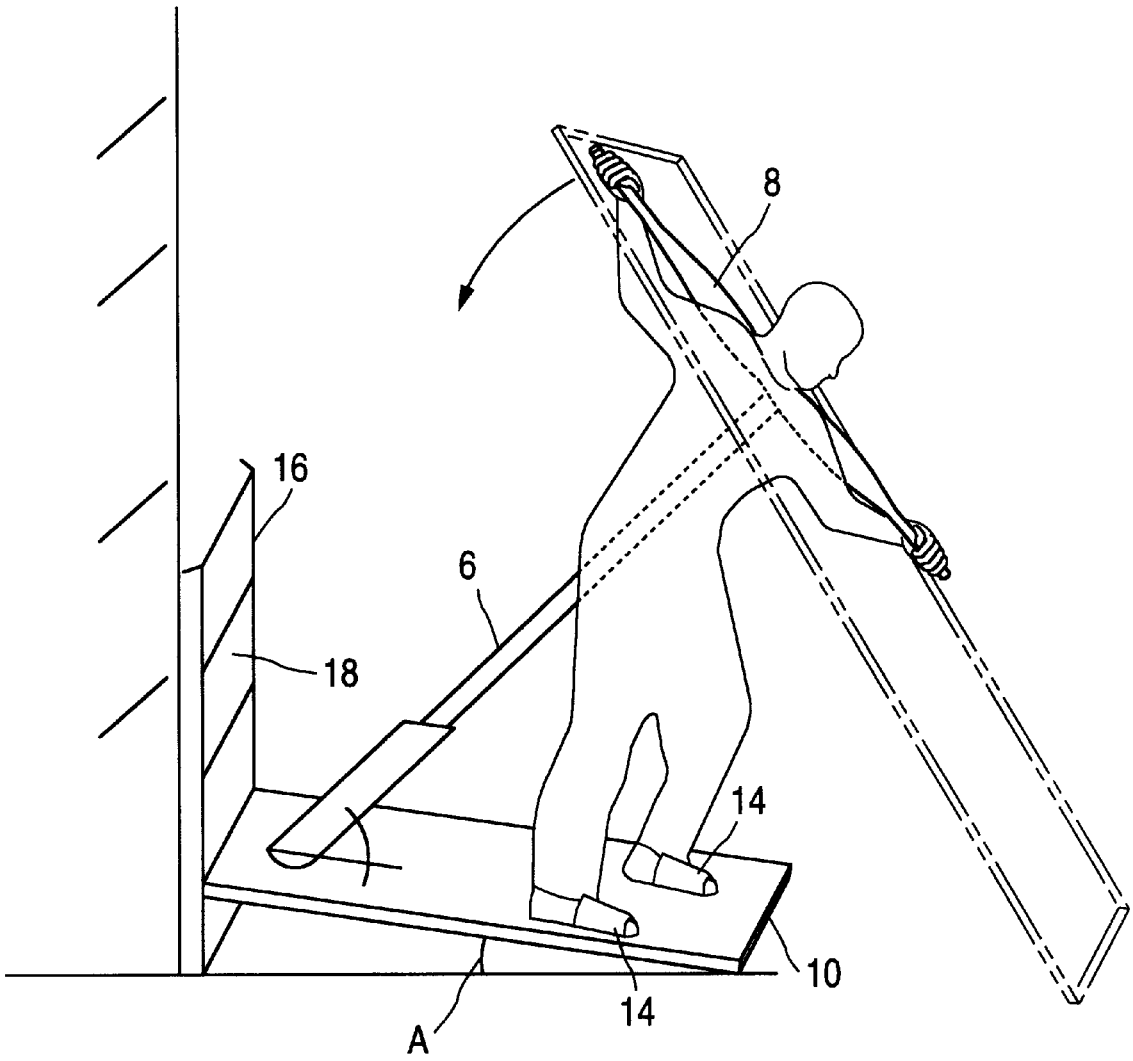
FIG. 3C is a perspective view of a golf exercise apparatus according to the present invention and illustrates an end of a support base coupled with a frame assembly wherein an angle A is formed between the support base and the plane of the floor.

Referring to FIG. 3C, any end of the support base 10 may be configured to couple with a frame assembly 16 to secure the support base 10 in a flat orientation, or in an uneven orientation so that the exerciser/golfer may perform exercises simulating a "ball lie" wherein the ball is above or below the feet of the golfer, or is in an uphill or downhill lie. The end of the support base may be wedged as in the previous embodiment. Alternatively, the end may have a hook attachment for coupling with a rung 18 of the frame assembly 16. Uneven ball lies occur during golf rounds and require a modified sense of balance and a slightly modified functional relationship between the muscles of the legs and other parts of the body of the golfer. Therefore, exercising with this embodiment of the present invention will improve the performance of a golfer when having an uneven lie during a golf round. The strengthening function of the exercise apparatus according to the present invention may be particularly useful for an uneven lie because the inherent instability of the stance of a golfer having such a lie during a golf round reduces his or her ability to utilize muscles of the axial skeleton and lower extremities in an optimal manner.

In a preferred embodiment of the present invention, foot anchors 14 are provided to secure the both feet of the exerciser/golfer to the support base 10. An incorrect golf swing often includes movement of one or both feet either along the plane of the ground or off of the ground. Because such movement is undesirable, the foot anchors 14 train the golfer to keep his or her feet stable on the ground during the golf swing. The foot anchors 14 have a further indirect function of keeping the golfer from varying the first rotational axis 2 or the second rotational axis 4 because such variation often accompanies foot movement.

The foot anchors 14 may secure the feet of the exerciser/golfer in a variety of ways. For example, the foot anchors may attach to the feet as would a stirrup, sandle or bicycle foot pedal, or they may secure the feet of the exerciser golfer like a ski holds a ski boot. The foot anchors 14 may be formed of one unadjustable piece of material or may be adjustable to tighten around the particular feet of the exerciser/golfer. The foot anchors 14 may be securable like a buckle on a shoe or belt, or with velcro or another fastening device such as are used to secure a belt or a strap on a dufflebag or backpack. Any conventional method of securing the feet of the exerciser/golfer may be utilized without departing from the scope of the present invention.

Use

Referring again to FIG. 2, during use of the exemplary embodiment of the present invention, the support base 10 is wedged under a door D using a reverse bevelled end 12. The feet of the exerciser/golfer are firmly secured to the support base via the foot anchors 14. The shoulders and upper torso of the exerciser/golfer are coupled with the axial shaft 6 via a shaft attachment assembly 8.

FIGS. 4A, 4B, and 4C, are a series of top views illustrating three positions along a simulated golf swing using the present invention to improve the strength and endurance of the muscles of the axial skeleton and lower extremities that power the golf swing. FIG. 4A shows a golfer in a starting position from which he or she may perform a repetition of an exercise utilizing the present invention. This starting position emulates the address position of a golf swing. In the starting position for performing a repetition with the first embodiment of the present invention, as in the address position of a golf swing, the feet of the exerciser/golfer are spaced apart approximately shoulder width. The knees are slightly bent as the exerciser/golfer assumes an athletic position.

Referring to FIG. 4B, the exerciser/golfer has moved from the starting position to a rotationally extended position, much as a golfer shifts from address into the backswing and to the top of the backswing. In this position at the top of the backswing, the weight of the exerciser/golfer is only slightly on the back foot, if at all, and the shoulders and upper torso are rotationally strained from the lower torso and hips. In this position, a large amount of rotational potential energy is stored in preparation for conversion to rotational kinetic energy, which should be maximized when in the position at the bottom of the downswing emulated by the position of FIG. 4C.

It is important for the exerciser/golfer to forego intuition when moving to the top of the backswing and to not try to store translational potential energy in the backswing by moving the upper torso over the back foot in preparation for a translational movement toward the ball. This translational movement will only interfere with the main objective of building rotational potential energy. As discussed, the golf exercise apparatus according to a preferred embodiment has only minimal translational play in the shaft/base coupling mechanism. Therefore, by using the golf exercise apparatus of the present invention, a golfer is trained not to veer translationally into an improper position at the top of the backswing.

The resistance is preferably progressive throughout the duration of the downswing from the top of the back swing to the point in the exercise shown in FIG. 4C akin to the point at which impact is made with the golf ball. Preferably, no resistance is provided against the motion of the golfer during the backswing. At the top of the backswing, as shown in FIG. 4B, a small resistance is felt.

Referring to FIG. 4C, the exerciser/golfer has moved from an intermediate position emulating the top of the back swing through the downswing to a position akin to the position of impact with the golf ball. As the downswing progresses, the resistance builds to a maximum at the point akin to the point of impact with the golf ball shown in FIG. 4C. This progressive resistance parallels proper swing dynamics, as a proper swing starts slowly and builds to rapid acceleration at the point of impact with the golf ball. The high resistance provided by the present invention at the point akin to the point of impact with a golf ball especially strengthens and trains the muscles most active at that point of the golf swing. As mentioned, a torsional spring is the ideal resistance to provide progressive resistance and is preferred.

The resistance provided by the golf exercise apparatus when the exerciser/golfer moves from the position of FIG. 4B to the position of FIG. 4C is a feature of the present invention that helps improve the overall strength and endurance of the muscles of the axial skeleton and lower extremities that power the golf swing. A golfer who regularly performs the exercise illustrated in FIGS. 4A–4C will build strength and dexterity, as well as the rotational sense discussed above, to enable him or her to more capably swing a golf club along the correct path with rotational awareness, strength and confidence.

Conclusion

From the foregoing description, it is believed apparent that the present invention provides a novel apparatus and technique for exercising and strengthening the muscles of the axial skeleton and lower extremities that participate in the golf swing. It should be understood, however, that the invention is not intended to be limited to the specifics of the illustrated embodiment, but rather is defined by the accompanying claims.

What is claimed is:

1. A golf exercise apparatus that provides resistance during an exercise emulating a golf swing of a golfer to strengthen muscles of the axial skeleton and lower extremities of the golfer performing the exercise, comprising:

a support base;

an axial shaft directly and rotatably coupled with said support base at angle acute angle such that the longitudinal axis of said axial shaft is substantially aligned with the longitudinal axis of the spine of said golfer performing said exercise; and means for resisting the muscles primarily of the axial skeleton and lower extremities of the golfer in a direction opposite to a direction of motion of the golf swing during said exercise emulating said golf swing when the golfer is coupled above the waist with the shaft of the exercise apparatus.

2. A golf exercise apparatus as in claim 1, wherein said resistance means provides resistance to the muscles of the golfer during a downswing of the golfer.

3. A golf exercise apparatus as in claim 1, wherein said support base comprises at least one end having a reverse bevel.

4. A golf exercise apparatus as in claim 3, wherein said reverse bevel is engageable beneath a door to secure it against movement.

5. A golf exercise apparatus as in claim 3, further comprising a support frame coupled with said support base at said end having said reverse bevel to stabilize said support base.

6. A golf exerciser as in claim 5, wherein said support base is positioned at an angle with respect to the plane of the ground to emulate an uneven lie.

7. A golf exercise apparatus as in claim 1, wherein said support base comprises at least one foot anchor for affixing at least one foot of the golfer to the support base.

8. A golf exercise apparatus as in claim 1, wherein said resistance means includes a torsional spring to provide torsional spring resistance to the muscles of the golfer during said golf swing.

9. A golf exercise apparatus as in claim 1, wherein said resistance means includes a pneumatic assembly to provide pneumatic resistance to the muscles of the golfer during said golf swing.

10. A golf exercise apparatus as in claim 1, wherein said resistance means includes a hydraulic assembly to provide hydraulic resistance to the muscles of the golfer during said golf swing.

11. A golf exercise apparatus as in claim 1, wherein said resistance means includes a spring assembly to provide kinematic resistance to the muscles of the golfer during the golf swing.

12. A golf exercise apparatus as in claim 1, wherein said axial shaft has a variable length.

13. A golf exercise apparatus as in claim 1, wherein said axial shaft forms an acute angle with said support base.

14. A golf exercise apparatus as in claim 13, wherein said acute angle is a variable angle.

15. A golf exercise apparatus as in claim 1, further comprising a support frame coupled with said support base to stabilize said exercise apparatus.

16. A golf exercise apparatus as in claim 15, wherein said support base is positioned at an angle with respect to the plane of the ground to emulate an uneven lie.

17. A golf exercise apparatus as in claim 1, wherein said resistance means comprises an elastic cord coupled with said golfer to provide elastic resistance to the muscles of the golfer during said golf swing.

18. A golf exercise apparatus as in claim 1, said apparatus being foldable for storage in a storage space.

19. A golf exercise apparatus as in claim 1, further comprising a shaft attachment which is coupled with both the golfer and the axial shaft to facilitate coupling of the shaft with the golfer.

20. A golf exercise apparatus as in claim 1, wherein said resistance means comprises a weighted coupling apparatus which is coupled with said golfer.

21. A golf exercise apparatus as in claim 1, wherein said resistance means provides progressive resistance.

22. A golf exercise apparatus as in claim 21, wherein said progressive resistance is lower when the golfer is in a first position emulating the top of a backswing than it is when the golfer is in a position akin to a point of impact with a golf ball.

23. A golf exercise apparatus as in claim 1, wherein said support base comprises two foot anchors for affixing two feet of the golfer to the support base.

24. A golf exercise apparatus as in claim 1, wherein said axial shaft is telescopable.

25. A golf exercise apparatus that provides resistance during an exercise emulating a golf swing of a golfer to strengthen muscles of the axial skeleton of the golfer performing the exercise, comprising:

a support means;

an shaft means directly and rotatable coupled with said support means at an acute angle such that the longitudinal axis of said shaft means is substantially aligned with the longitudinal axis of the spine of said golfer performing said exercise; and means for resisting the muscles primarily of the axial skeleton and lower extremities of the golfer in a direction opposite to a direction of motion of the golf swing during said exercise emulating said golf swing when the golfer is coupled above the waist with the shaft means of the golf exercise apparatus.

26. A golf exercise apparatus that provides resistance during an exercise emulating a golf swing of a golfer to strengthen muscles of the axial skeleton and lower extremities active in the golf swing of the golfer performing the exercise, comprising:

a support base;

an axial shaft directly and rotatable coupled with said support base such that the longitudinal axis of said axial shaft is substantially aligned with the longitudinal axis of the spine of said golfer performing said exercise;

means for resisting the muscles of the golfer during said exercise emulating said golf swing when the golfer is coupled with the shaft of the exercise apparatus;

a support frame coupled with said support base to stabilize said support base;

at least one foot anchor on said support base for affixing at least one foot of the golfer to the support base;

a shaft attachment coupled to axial shaft and supportable above the waist of the golfer, and wherein said resistance means provides progressive resistance starting with minimal resistance when the golfer is in a first position emulating the top of a backswing and finishing with optimal resistance when the golfer is in a second position emulating a position akin to a point of impact with a golf ball, and wherein said axial shaft forms a variable acute angle with said support base.

27. A golf exercise apparatus as in claim 26, wherein said resisting means includes a torsional spring to provide torsional spring resistance to the muscles of the golfer during said golf swing.

28. A golf exercise apparatus as in claim 26, wherein said resisting means includes a pneumatic assembly to provide pneumatic resistance to the muscles of the golfer during said golf swing.

29. A golf exercise apparatus as in claim 26, wherein said resistance means includes a hydraulic assembly to provide hydraulic resistance to the muscles of the golfer during said golf swing.

30. A golf exercise apparatus as in claim 26, wherein said resistance means includes a spring assembly to provide kinematic resistance to the muscles of the golfer during the golf swing.

31. A golf exercise apparatus as in claim 26, wherein said resistance means comprises an elastic cord coupled with said golfer to provide elastic resistance to the muscles of the golfer during said golf swing.

32. A golf exerciser, comprising:

a base a pivotable elongated mechanism including first and second ends defining a longitudinal axis directly and pivotably coupled at an acute angle to said base at said second end such that the longitudinal axis of said pivotable elongated mechanism is substantially aligned with the longitudinal axis of the spine of a user performing an exercise; and a user attachment rotatably and resistively coupled to the pivotable mechanism at a pivot location, the pivotable mechanism configured to be mounted above the waist of a user, wherein resistance to rotation of said user attachment relative to said pivotable mechanism is provided at the pivot location.

* * * * *